US006659683B1

(12) United States Patent
Yamamoto et al.

(10) Patent No.: US 6,659,683 B1
(45) Date of Patent: Dec. 9, 2003

(54) ANTI-SLIPPING AGENT FOR FROZEN ROAD SURFACE AND SPREADING METHOD THEREOF, AND APPARATUS FOR SPREADING THE ANTI-SLIPPING AGENT FOR FROZEN ROAD SURFACE

(75) Inventors: Chisato Yamamoto, Iwate-ken (JP); Hideki Onodera, Iwate-ken (JP); Genzo Kato, Iwate-ken (JP)

(73) Assignee: Kohyu Sangyo Yugen Kaisha, Iwate-Ken (JP)

( * ) Notice: Subject to any disclaimer, the term of this patent is extended or adjusted under 35 U.S.C. 154(b) by 0 days.

(21) Appl. No.: 09/486,421

(22) PCT Filed: Aug. 26, 1998

(86) PCT No.: PCT/JP98/03779

§ 371 (c)(1),
(2), (4) Date: Feb. 25, 2000

(87) PCT Pub. No.: WO99/10602

PCT Pub. Date: Mar. 4, 1999

(30) Foreign Application Priority Data

Aug. 26, 1997 (JP) ..... 9-229375
Oct. 27, 1997 (JP) ..... 9-294065
Jun. 26, 1998 (JP) ..... 10-180469

(51) Int. Cl.[7] ..... E01C 11/24
(52) U.S. Cl. ..... 404/19; 404/20
(58) Field of Search ..... 404/80, 79, 77, 404/19, 20, 21, 75, 95, 108, 110

(56) References Cited

U.S. PATENT DOCUMENTS 3,554,449 A * 1/1971 Currie ..... 239/135
3,656,306 A * 4/1972 Thorpe ..... 404/77
3,797,951 A * 3/1974 Zichner ..... 404/19
3,827,736 A * 8/1974 Mango ..... 291/20
3,973,973 A * 8/1976 Leach ..... 106/400
3,992,340 A * 11/1976 Bonitz ..... 260/28.5
4,544,304 A * 10/1985 Fisher ..... 404/17
4,575,010 A * 3/1986 Zimmerman ..... 239/130
4,812,076 A * 3/1989 Yant ..... 404/77
4,978,068 A * 12/1990 Eldridge ..... 239/129
5,224,990 A * 7/1993 Vicenzi et al. ..... 106/277
5,248,466 A * 9/1993 Russell, III ..... 264/72
5,291,876 A * 3/1994 Milstead ..... 126/343.5
5,362,314 A * 11/1994 Vicenzi et al. ..... 106/284.06
5,496,615 A * 3/1996 Bartlett et al. ..... 428/144
5,593,246 A * 1/1997 Hedblom et al. ..... 404/9
5,618,132 A * 4/1997 Fogg et al. ..... 404/79
5,698,021 A * 12/1997 Dorsett ..... 106/36

FOREIGN PATENT DOCUMENTS

| | | |
|---|---|---|
| DE | 11 32 174 B | 6/1962 |
| JP | 6-003843 | 2/1994 |
| JP | 7-030301 | 4/1995 |
| JP | 8-209107 | 8/1996 |
| JP | 9-195242 | 7/1997 |
| JP | 10-102413 | 4/1998 |

* cited by examiner

*Primary Examiner*—Thomas B. Will
*Assistant Examiner*—Raymond W Addie
(74) *Attorney, Agent, or Firm*—Weingarten, Schurgin, Gagnebin & Lebovici LLP

(57) ABSTRACT

An anti-slipping agent for a frozen road surface is provided by crushing a stone having flat-crushability such as black slate into flat-crushed pieces of a required grain size. Furthermore, a method for spreading an anti-slipping agent for a frozen road surface is provided in which the anti-slipping agent for a frozen road surface is heated and then spread onto the frozen road surface. Further an apparatus is provided for spreading an anti-slipping agent for a frozen road surface onto a frozen road surface, which has a hopper, a heater and a spreader.

2 Claims, 3 Drawing Sheets

ANTI-SLIPPING AGENT FOR FROZEN ROAD SURFACE AND SPREADING METHOD THEREOF, AND APPARATUS FOR SPREADING THE ANTI-SLIPPING AGENT FOR FROZEN ROAD SURFACE

TECHNICAL FIELD

The present invention relates to an anti-slipping agent for a frozen road surface and a spreading method thereof and more particularly to an anti-slipping agent for a frozen road surface to increase the friction between tires of vehicle and a road surface by spreading it onto a road surface covered with snow or a frozen surface, and to a method for spreading it. The present invention further relates to an apparatus for spreading the anti-slipping agent for a frozen road surface onto the road surface.

BACKGROUND ART

On roads in winter, a slippery road surface state (skid number: about 20) and a significantly slippery road surface state (skid number: 10-0) frequently occur under a variety of conditions. From the viewpoint of the maintenance of road surfaces in winter, therefore, efforts are being made to ensure traffic safety, by setting a target of the road surface state at skid numbers of 30 or larger. FIG. 1 is a schematic diagram showing the relationship among the road surface state, running speed of vehicles and skid number. The range shown by A is a state of road surface having ice sheet or ice film thereon, and the range shown by B is a state of road surface having compressed snow or grainy snow thereon. And the range shown by C is a state of pavement surface in wet conditions, and the range shown by D a state of pavement surface in dry conditions. The symbol "a" corresponds to a sliding friction coefficient represented by skid number 30, "b" a sliding friction coefficient represented by skid number 20, "c" a sliding friction coefficient represented by skid number 10, "d" a sliding friction coefficient represented by skid number 0.

The most important measures to improve skid number are to prevent snow and/or ice from remaining on road surfaces. In order to carry out snow removal thoroughly, therefore, the usage of snowplow, the spreading of anti-freezing agents, sand, or the like for slip prevention, the roughening of frozen road surfaces by specialized instruments etc. are being executed as measures to improve skid number. However, sufficient results have not been obtained.

For example, materials used as anti-freezing agents, for the most part, consist of calcium chloride and sodium chloride (so-called salts). These salts used as anti-freezing agents, as well as sands for anti-slipping are both prone to fly away beyond roads when spread, depending on their specific gravity or particle diameter. After being spread onto a road surface, therefore, they are further whirled up by traveling vehicles without fixing to the road surface, and thus their slip prevention effect is hard to be maintained for a long time. In a case where a salt is employed, when the temperature of aqueous solution of the salt drops, the solution refreezes and renders a road surface to an ice board, which readily causes traffic failures. Furthermore, since a large amount of salt is usually used, there are growing apprehensions of the occurring of salt damage to environment and vehicles, and of environmental pollution.

For spreading of sand for anti-slipping, natural sand or crushed sand of stone is typically used. Even if an anti-slipping agent such as these natural sand or crushed sand of stone is spread onto a frozen road surface, however, they are whirled up by traveling vehicles and readily flies away to the roadsides or beyond the road. This creates a problem that their slip prevention effects cannot be retained for a long period of time. For example, if about a hundred vehicles pass on a road surface with an anti-slipping agent spread thereon, then a considerable amount of the anti-slipping agent frequently flies away and loses its slip prevention effect in about one to two hours. This results in an inconvenience that the use frequency and/or the spread quantity of anti-slipping agent must be increased to ensure traffic safety.

Accordingly, it is an object of the present invention to overcome the above-mentioned drawbacks associated with the conventional methods, that is, that neither of salts and sands are so high in the slip prevention effect on road surfaces in winter and that secondary failures such as the refreezing of aqueous solution of the salt used take place. It is another object of the present invention to eliminate any pollution by salt damage and improve the fixing property of an anti-slipping agent spread onto a frozen road surface, thereby retaining its slip prevention effect for a long period of time.

SUMMARY OF INVENTION

A first embodiment of the present invention is an anti-slipping agent composed of flat-crushed pieces obtained by crushing a stone having flat-crushability such as black slate as a raw material into small particles with increased flatness, through taking advantage of their flat-crushability. Since the crushed pieces of this anti-slipping agent for a frozen road surface are flat and have relatively high specific gravity (approximately 2.7), they can be spread unfailingly onto a road surface without flying away while being spread. When spread, therefore, the anti-slipping agent has a higher road covering efficiency per unit weight. Since it contacts the road surface closely and stabilizes, i.e., it has a good fixing property; its slip prevention effect can be retained for a long period of time.

A second embodiment of the present invention is a method for heating and spreading the anti-slipping agent for a frozen road surface. Because larger particles of the anti-slipping agent have higher heat capacities and smaller particles have lower heat capacities, when fixing to a road surface covered with snow and/or ice, the anti-slipping agent melts the snowy and/or icy road surface and quickly forms irregularities thereon, for improving the slip prevention effect.

Furthermore, a third embodiment of the present invention is an apparatus for spreading an anti-slipping agent for a frozen road surface, comprising: a hopper into which the anti-slipping agent is charged, heating means for heating the anti-slipping agent, and spreading means for spreading diffusely the heated anti-slipping agent onto a road surface. By this anti-slipping agent spreading apparatus in accordance with the present invention, the anti-slipping agent for a frozen road surface can be heated from about 100° C. and then spread onto the frozen road surface.

As mentioned above, within this heated anti-slipping agent for a frozen road surface, the heat capacity varies according to the size of particle of the anti-slipping agent for a frozen road surface. When particles of the anti-slipping agent for a frozen road surface that have different heat capacities are spread on the frozen road surface, irregularities are formed on the frozen road surface that is being melted. Therefore, the slip prevention effect of the anti-slipping agent for a frozen road surface itself that has fixed to the road surface, and the frozen road surface having irregularities formed by anti-slipping agent, allows in combination the slip prevention effect to be retained for a long period of time and to be improved.

DETAILED DESCRIPTION OF THE INVENTION

Figure 1:
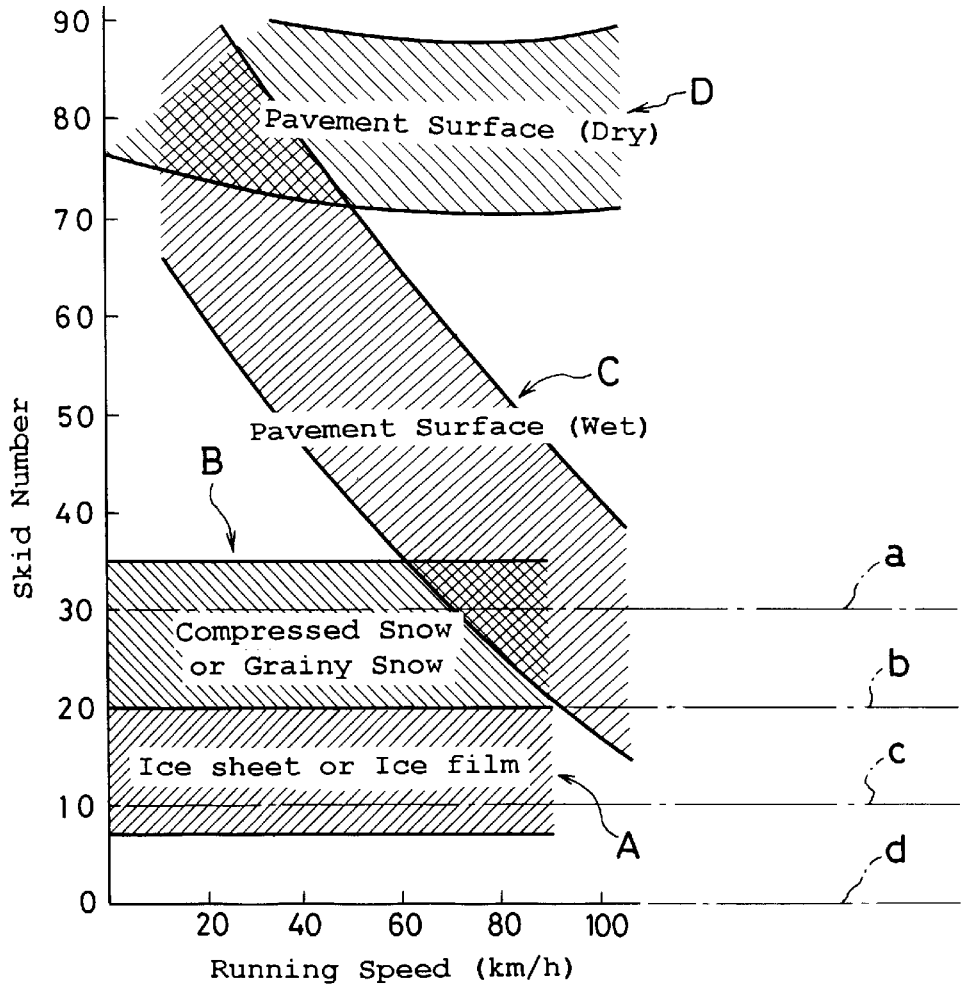
FIG. 1 is a schematic diagram showing the relationship among the road surface state and running speed of vehicles and skid number.

The anti-slipping agent for a frozen road in accordance with an embodiment of the present invention utilizes a stone having flat-crushability as a raw material, for example, black slate may be utilized. The black slate can be crushed into flat thin plates. When these plates are further crushed by a centrifugal crusher, they fly away centrifugally into the direction in which they suffer the least resistance, and upon undergoing shock on their sides of the flat surfaces, they are crushed into a minuter and more flat state, forming small particles of flat-crushed pieces. For example, black slate as a raw material that has been crushed by a crusher into an appropriate size is used. When this crushed black slate is further put into an upright rotation centrifugal crusher (turbo hammer), a strong crushing force is applied vertically to the side of the flat surface, and the crushed black slate is further crushed into more minute and more flat pieces due to a shock by the crushing force; by making use of this mechanism, flat-crushed pieces of predetermined grain size are derived. And then, by screening these crushed pieces with the aid of a screen and selecting an appropriate grain size, the anti-slipping agent can be obtained. Grain size thereof is in a range of 4.0–1.5 m/m.

Using various kinds of crushed pieces, their slip prevention effects were tested, and the results are shown below.

Black slate (natural slate) and a stone having flatness that had been crushed by a single toggle crusher into crushed pieces of about 50 m/m were put together into an upright rotational centrifugal crusher (turbo hammer OMSP type) and were crushed by this crusher at a main shaft rotational speed of 900 r.p.m to 1300 r.p.m. into black flat-crushed pieces having diameters of 4 m/m or less. With the aid of a vibrating screen classifier (OP type), these crushed pieces were screened and classified into 4.0–1.5 m/m, and 3.0–1.0 m/m classes. And then, skid numbers for snowy and/or icy road surfaces onto which these crushed pieces have been spread were measured over time, using: Sample No.1 (1.5–4.0 m/m, spreading volume 150 g per $m^2$), Sample No.2 (1.0–3.0 m/m, spreading volume 200 g per $m^2$), Sample No.3 (1.0–3.0 m/m, spreading volume 100 g per $m^2$), Sand (silica stone) (1.0–3.0 m/m, spreading volume 200 g per $m^2$). Results of measurement are shown in Table 1.

Execution date: Feb. 20, 1997; 13:00–19:00.

Execution place: National route 225 at Higashi-futo-dori, Shin-minato, Ishikari-machi, Hokkaido (1,700 m in length).

Measuring method: measurement of skid numbers by means of a sliding resistance measurement car of Hokkaido University type.

Measurer: Transportation laboratory, Engineering faculty of Hokkaido University.

State of road surface: from compressed snow state to ice board state (skid number: average 15).

Road surface temperature: from −1.5° C. to −5.8° C.

Traffic volume: 744 vehicles (ordinary cars: 338, large-sized cars: 406).

TABLE 1

| Elapsed time after spreading sample | 1 hr. | 2 hrs. | 3 hrs. | 4 hrs. | 5 hrs. | 6 hrs. | Description of sample of anti-slipping agent for a frozen road surface |
|---|---|---|---|---|---|---|---|
| Sample No. 1 | 42 | 39 | 39 | 37 | 38 | 37 | 1.5–4.0 m/m 150 g per $m^2$ |
| Sample No. 2 | 33 | 30 | 30 | 31 | 25 | 23 | 1.0–3.0 m/m 200 g per $m^2$ |
| Sample No. 3 | 28 | 27 | 25 | 24 | 23 | 22 | 1.0–3.0 m/m 100 g per $m^2$ |
| Sand (silica stone) | 32 | 23 | 20 | 15 | 16 | 13 | 1.0–3.0 m/m 200 g per $m^2$ |

It is seen from these results, that Sample No. 1 shows the highest indices as an anti-slipping agent. This means that Sample 1 can be retained on the road surface for a long period of time and is the most suitable for practical use, because Sample 1 has a large grain size and has a good fixity to a road surface, hence showing a skid number of 30 or larger. For sand, crushed sand of silica stone that has a highest hardness of stones, was used. It could be ascertained from the results that the sand shows a large index for about an hour after spreading, but thereafter it has little slip prevention effect because they do not fix to the road surface due to the scattering by traveling vehicles.

The results of analysis for Sample 1 to Sample 3 are shown in Table 2.

TABLE 2

| Constituents (%) | $SiO_2$ | $Al_2O_3$ | $Fe_2O_3$ | CeO | $Na_2O \cdot K_2O$ MgO contained |
|---|---|---|---|---|---|
| | 63 | 11 | 4 | 1.7 | Specific gravity: 2.78 |

From the above-mentioned test results, it is recognized that flat-crushed pieces of black slate have a good road covering efficiency (covering efficiency per unit eight) for a snowy and/or icy road surface, because they fix to the road surface at their flat surfaces when spread, by virtue of their flat shape, and that their specific gravity (about 2.7) has a very suitable value for spreading. Since, during being spread onto a snowy and/or icy road surface, these crushed pieces suffer no scattering beyond the road caused by wind, i.e., cause no pollution, and fix to the snowy and/or icy road surface at their flat surfaces, the fixing property of the flat-crushed pieces themselves is very good. In fact, their slip prevention effect were maintained for a long period of time without being whirled up by traveling vehicles. From the above test results, grain sizes ranging from about 4.0–1.5 m/m are recommended as advantageous grain sizes for spreading of such flat-crushed pieces.

Now, concerning the effect of usage of the anti-slipping agent for a frozen road surface in accordance with an embodiment of the present invention upon the braking distance of vehicles, the average braking distance of vehicles on a frozen road surface was 44.9 m (40 km/h, with studless tires) when no anti-slipping agent was spread, while a result of an average braking distance of 24.5 m was obtained when the present anti-slipping agent for a frozen road surface was spread. Thus, the use of the anti-slipping agent reduces nearly by half the braking distance, which verifies that the agent has a great effect on traffic safety. In this case, the anti-slipping agent for a frozen road surface spread onto the road surface showed a good fixity to the road surface, maintaining its effect for a longer period of time (6 hours or longer) in comparison with salts or sand, which lose their effects in 1 to 2 hours.

It is preferable that the anti-slipping agent for a frozen road surface is heated from 100° C. to 300° C. prior to spreading onto a road surface. Because, when the above-mentioned anti-slipping agents for a frozen road surface are spread onto a road surface after being heated to a temperature of 100° C. or higher, the heated anti-slipping agents, of which larger particles have higher heat capacities and smaller particles have lower heat capacities, melt the surface, and quickly forms irregularities thereon when fixing to the snowy and/or icy road surface, thereby improving the slip prevention effect. Further, as a constituent of the anti-slipping agent, $SiO_2$, which can accumulate heat internally, is contained therein by 60% or more and contributes to the improvement in the fixing of the anti-slipping agent onto a road surface. They may be heated immediately before spreading.

Figure 2:
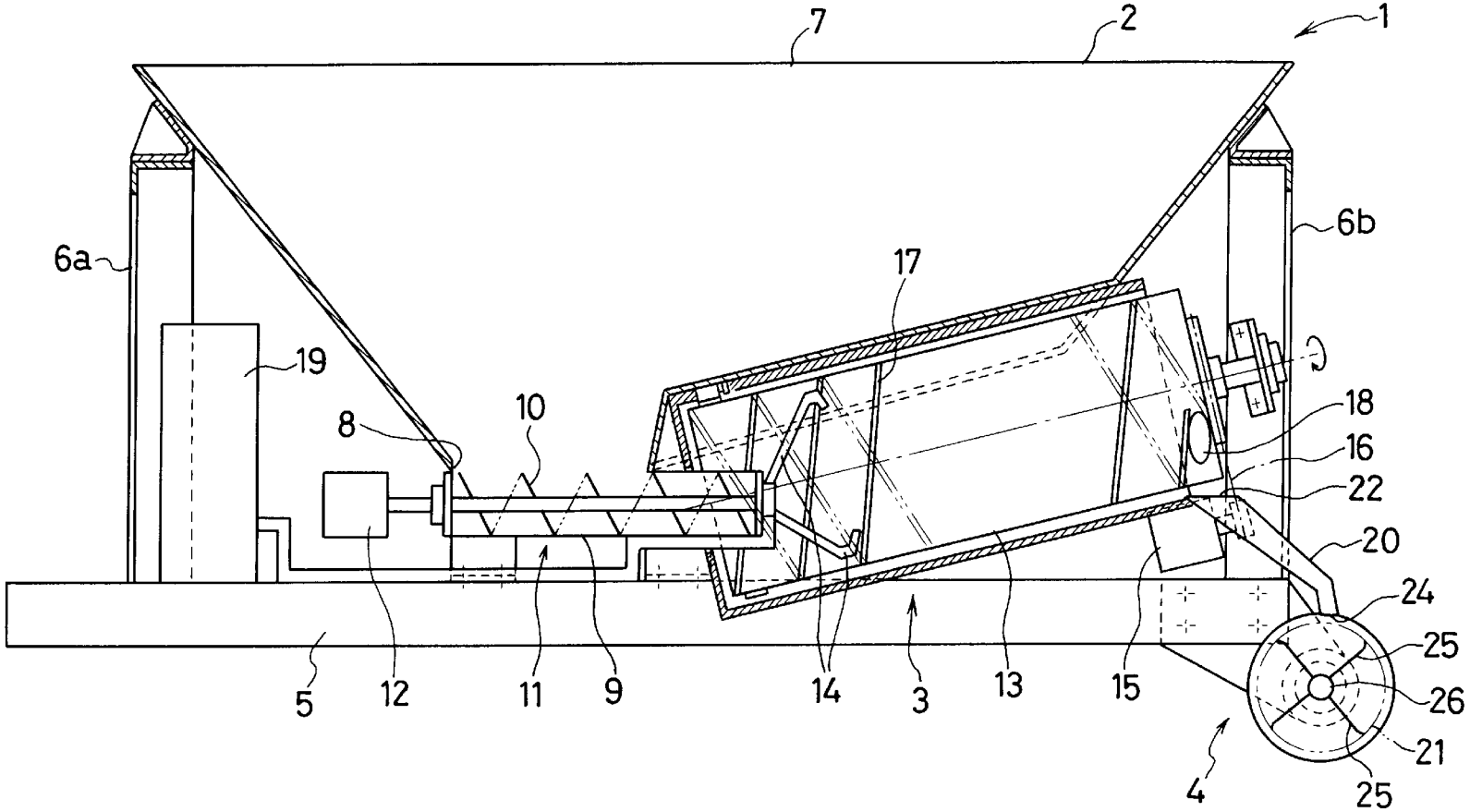
FIG. 2 is a partial sectional view showing an embodiment of the apparatus for spreading anti-slipping agent for a frozen road surface in accordance with the present invention.
Figure 3:
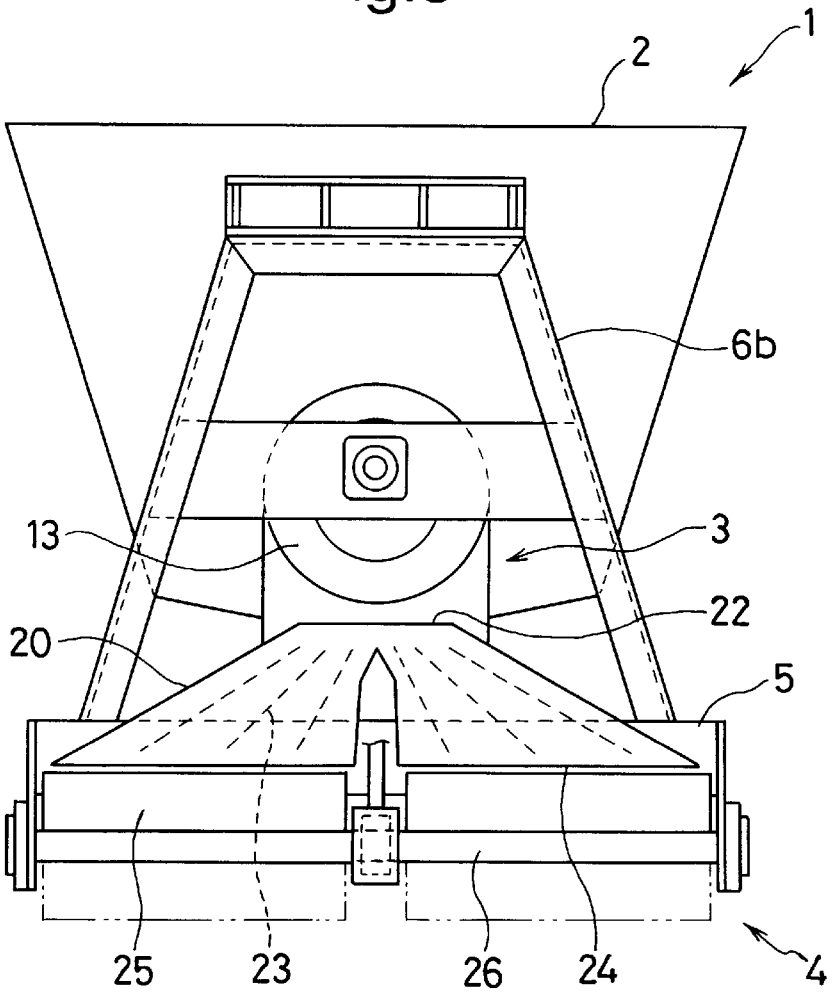
FIG. 3 is an explanatory view of the embodiment of the apparatus for spreading an anti-slipping agent for a frozen road surface in accordance with the present invention, as viewed from the spreader side.

Next, an apparatus for spreading the anti-slipping agent for a frozen road surface will be described below in detail, based on an embodiment shown in FIGS. 2 and 3.

Reference numeral 1 in the figures denotes an apparatus for spreading an anti-slipping agent for a frozen road surface that is installed on a load-carrying platform of a vehicle such as a truck, the apparatus 1 comprising a hopper 2, a heater 3 and a spreader 4. The hopper 2 is supported on a pair of frames 6*a* and 6*b* that have been raised at a front side and a rear side thereof from a bed plate 5, and the hopper 2 has an upper side that is opened as a charging opening 7 for an anti-slipping agent for a frozen road surface and a lower side that is opened as a delivery opening 8, with the section of the hopper 2 diverged toward its top side. The hopper 2 is charged preferably with the anti-slipping agent for a frozen road surface in accordance with the present invention.

At the delivery opening 8 of the hopper 2 situated is a feed section 11 in which a spiral plate 10 is disposed rotatably within a horizontal tube 9 coupled with the delivery opening 8. The anti-slipping agent for a frozen road surface that has been charged into the hopper 2 is delivered into one direction through the rotation of the spiral plate 10 by a first power source 12 connected to the spiral plate 10.

The heater 3 into which the anti-slipping agent for a frozen road surface is delivered from the hopper 2 via the feed section 11 is disposed at the forward part of the feed section 11 in the delivery direction. The heater 3 is comprised of a heating cylinder 13 which is located at the lower part of hopper 2 and into which the front end of feed section 11 in the delivery direction is inserted, a burner 14 which is mounted at the front end of the feed section 11, and a second power source 15. The heating cylinder 13 is tilted obliquely upward from the feed section side, and its end of the side opposite to the feed section side is rotatably pivoted on one frame 6*b* side. The heating cylinder 13 is rotated by power transmitted from the second power source 15 disposed on the frame 6*b* side, via a transmitting member 16 such as a belt. The heating cylinder 13 is provided with a spiral guide plate 17 on its inner circumference in order to further send up the anti-slipping agent for a frozen road surface fed from the feed section 11 along the slope of the heating cylinder 13, from the delivery direction of the feed section 11 toward the forward direction of the heating cylinder 13. The spiral guide plate 17 is adapted to send up the anti-slipping agent for a frozen road surface toward the upper end side of the heating cylinder 13 by the rotation of the heating cylinder 13 under the guidance of the spiral guide plate 17.

As described above, the heating cylinder 13 has a burner 14 therein, and causes the anti-slipping agent for a frozen road surface to be sent forth while receiving combustion heat from the burner 14 and radiant heat of the heating cylinder itself. When the anti-slipping agent for a frozen road surface that has been raised in temperature to a predetermined temperature reaches a discharge opening 18 that is opened on the upper end side of the heating cylinder 13 and when the discharged opening 18 comes to be positioned on the underside of the heating cylinder 13 by the rotation of the same, the anti-slipping agent for a frozen road surface that has been raised in temperature is adapted to be discharged from the heating cylinder 13. Reference numeral 19 denotes a fuel container which feeds fuel to the burner 14.

The anti-slipping agent for a frozen road surface, which is heated so as to rise in temperature from about 100° C. to about 300° C., is given a temperature setting by adjusting the combustion of burner according to the quantity of the anti-slipping agent for a frozen road surface passing through the heating cylinder 13.

The spreader 4 is disposed so as to receive the anti-slipping agent for a frozen road surface falling from the discharge opening 18 of the heating cylinder 13 in the heater 3, and is composed of a guiding nozzle 20 and a spreading mechanism 21. The guiding nozzle 20 diverges and opens downward as illustrated in the drawing so as to guide the anti-slipping agent for a frozen road surface that has entered from an upper opening 22 so that the anti-slipping agent spreads into one direction by a guide plate 23 that is located therein. Furthermore, the anti-slipping agent for a frozen road surface falling from a lower opening 24 of the guiding nozzle 20 is spread toward a road surface by the rotation of the spreading mechanism 21 which is placed opposite to and below the lower opening 24 and which comprises a rotating shaft 26 provided with a plurality of spreading blades 25. Further, the power source for rotating the spreading mechanism is not shown.

The spreading of the anti-slipping agent for a frozen road surface is performed by traveling a vehicle which has the apparatus 1 for spreading an anti-slipping agent for a frozen road surface mounted therein. Although one embodiment of this anti-slipping agent spreading apparatus that is mounted on a load-carrying platform of a truck is shown here, an alternative apparatus of towable type may also be used.

Thus, the apparatus for spreading an anti-slipping agent for a frozen road surface is arranged to spread an anti-slipping agent that has been raised in temperature onto a frozen road surface, and as described above, on the melting of the frozen road surface onto which the anti-slipping agent has been spread by the traveling of the vehicles which has the apparatus 1 mounted therein, irregularities are formed on the surface, because there are differences in the size of particles of the anti-slipping agent for a frozen road surface used. Therefore, the improvement in slip prevention effect due to irregularities formed on a surface that is being melted, and the slip prevention effect of the anti-slipping agent for a frozen road surface itself due to its good fixing property permits in combination a high slip prevention effect to be retained for a long period of time.

The spreading quantity of an anti-slipping agent for a frozen road surface is adjusted by controlling the feed amount to the heating cylinder through the adjustment of the number of revolution of the spiral plate in the feed section. The variation in spread quantity per hour onto a frozen road surface with the variation in traveling conditions of the present spreading apparatus may be adapted by this adjustment of feed amount to the heating cylinder. Further, the temperature adjustment of the anti-slipping agent for a frozen road surface is also performed by the combustion adjustment of burner as described above, which is easy to execute.

Skid number values for a frozen road surface were measured for the case where an anti-slipping agent for a frozen road surface was spread onto a frozen road surface using the apparatus for spreading an anti-slipping agent for a frozen road surface with said structure, and for the case where the anti-slipping agent for a frozen road surface was spread not using the same, i.e., where the anti-slipping agent for a frozen road surface was spread without being heated. The results are shown in Table 3. As an anti-slipping agent for a frozen road surface, sand (silica sand) was employed. The anti-slipping agent for a frozen road surface spread by the anti-slipping agent spreading apparatus was raised in temperature to 100° C.±20° C. before being spread. The temperature measurement of which results are shown in the table below, were executed on the frozen road surface onto which the anti-slipping agent was spread.

TABLE 3

| | | | | | | |
|---|---|---|---|---|---|---|
| Elapsed time after spreading (hr.) | | 1 | 2 | 3 | 4 | 5 |
| Road surface temperature (° C.) | | −2.3 | −2.6 | −4.3 | −4.7 | −5.0 |
| Accumulative total of traveling vehicles | | 86 | 143 | 206 | 271 | 344 |
| Skid number | Anti-slipping agent (unheated) | 32 | 23 | 20 | 15 | 13 |
| | Anti-slipping agent (heated) | 43 | 41 | 38 | 37 | 35 |

Typically, the skid number value for a frozen road surface is 10 to 20, the value for a road surface covered with compressed snow is 20 to 30, and the value such as to provide a slip prevention effect is larger than 30.

As seen in the measurement results in Table 3, when the anti-slipping agent for a frozen road surface was spread without being heated, the skid number value measured at the elapsed time of 1 hour after spreading was 32, but the values measured at the elapsed time of 2 hour after spreading and afterward, became smaller than 30. In contrast to this, it was ascertained, when the heated anti-slipping agent for a frozen road surface is spread using the apparatus for spreading an anti-slipping agent for a frozen road surface, a high effect of preventing slipping was retained for a long period of time.

The spreading density of an anti-slipping agent for a frozen road surface when spread onto a frozen road surface using the present apparatus 1 for spreading an anti-slipping agent for a frozen road surface is not particularly limited. An anti-slipping agent may be spread in such a way that the spreading density in the width direction of the road surface is substantially constant, or in such a way that the anti-slipping agent is spread at a higher spreading density onto spots where the degree of vehicle tire contact is heavier in the width direction of the road surface. Such an adjustment of spreading density by equalizing the spreading density in the width direction of the road surface, or by selectively increasing the spreading density at specified spots can be implemented by a method such as the change in position or the change in tilting of the guide plate.

The spreading density of an anti-slipping agent for a frozen road surface in the longitudinal direction of the road surface may be not only even, but also be varied according to road conditions. For example, onto a place such as a road surface in front on an intersection, where vehicles must brake properly, the anti-slipping agent may be spread at a higher spreading density. Furthermore, a system may be constructed that automatically spreads an anti-slipping agent for a frozen road surface while moving the apparatus for spreading an anti-slipping agent for a frozen road surface, and that has an added structure that spreads the anti-slipping agent for a frozen road surface so that the spreading density of the anti-slipping agent automatically changes when approaching a preset place (a place such as a road surface in front of an intersection, as mentioned above).

Industrial Applicability

As described above, one embodiment of the present invention is directed to an anti-slipping agent for a frozen road surface, composed of flat-crushed pieces having a required grain size obtained by crushing a stone having flat-crushability such as black slate. When this anti-slipping agent for a frozen road surface is spread onto a road surface, its flat-crushed pieces contact the snowy and/or icy road surface closely, and thereby can retain its slip prevention effect (skid number: about 30) for a long period of time, differing from salts or sands which decrease significantly in their slip prevention effect because of the scattering by traveling vehicles.

Since the present anti-slipping agent has a relatively high specific gravity (2.7) and does not fly away beyond a road when spread like salts or sands, it can be appropriately spread onto a road surface in a target direction for spreading. In addition, a stone having flat-crushability such as slate as a raw material is one of natural resources and a pollution-free matter. It has no danger of causing pollution, therefore, and is suitable for environmental conservation.

The second embodiment of the invention is directed to a method for heating and spreading the present anti-slipping agent for a frozen road surface onto a road surface. In accordance with this method, heated particles of the anti-slipping agent melt the surface and quickly form irregularities thereon, because larger particles of the heated anti-slipping agent have larger heat capacities and smaller particles have smaller heat capacities, and thus the heated particles enhance their slip prevent effect when fixing to the snow and/or icy road surface.

The third embodiment of the present invention is directed to an apparatus for spreading an anti-slipping agent for a frozen road surface, the apparatus comprising: a hopper into which an anti-slipping agent for a frozen road surface is charged, a heater for heating the anti-slipping agent for a frozen road surface that has been delivered from the hopper, from about 100° C. to about 300° C., and a spreader for spreading the anti-slipping agent for a frozen road surface that has been heated by the heater, onto the road surface in a diffused state, wherein this anti-slipping agent spreading apparatus can heat the anti-slipping agent for a frozen road surface from about 100° C. to about 300° C. and spread onto the frozen road surface so that the anti-slipping agent for a frozen road surface which has been heated to an elevated temperature can be spread easily and safely without the need of manpower. By spreading the anti-slipping agent for a frozen road surface that has been heated to an elevated temperature onto a frozen road surface, irregularities are formed on the frozen road surface and the slip prevention effect of the road surface itself is improved, as well as the fixing property of the anti-slipping agent for a frozen road surface is enhanced, so that a high slip prevention effect can be retained for a long period of time, exerting an excellent effect of slip prevention in practical application.

It will be apparent to those skilled in the art that other modifications to and variations of the above-described techniques are possible without departing from the inventive concepts disclosed herein. Accordingly, the invention should be viewed as limited solely by the scope and spirit of the appended claims.

What is claimed is:

1. A method for spreading an anti-slipping agent for a pavement surface covered with snow and/or ice, comprising the steps of:

(a) providing an anti-slipping agent consisting of flat-crushed pieces obtained by crushing a black slate having flat-crushability to a grain size range of 4.0 to 1.5 mm; and (b) spreading said anti-slipping agent from a hopper onto said pavement surface.

2. A method for improving a slip prevention effect on a pavement for vehicles, comprising the steps of:

(a) providing an anti-slipping agent consisting of flat-crushed pieces obtained by crushing a black slate having flat-crushability to a grain size range of 4.0 to 1.5 mm; and (b) spreading said anti-slipping agent onto a pavement surface covered with snow and/or ice in an amount sufficient to provide a skid number of 30 or more.

* * * * *

UNITED STATES PATENT AND TRADEMARK OFFICE

CERTIFICATE OF CORRECTION

PATENT NO. : 6,659,683 B1
DATED : December 9, 2003
INVENTOR(S) : Chisato Yamamoto et al.

It is certified that error appears in the above-identified patent and that said Letters Patent is hereby corrected as shown below:

Column 8,
Line 24, "on" should read -- of --.

Signed and Sealed this

Eleventh Day of January, 2005

JON W. DUDAS
*Director of the United States Patent and Trademark Office*